US005285853A

United States Patent [19]

Eckert et al.

[11] Patent Number: 5,285,853

[45] Date of Patent: Feb. 15, 1994

[54] CASING HANGER SEAL WITH TEST PORT

[75] Inventors: Lawrence A. Eckert; Carl F. Boehm, Jr., both of Houston, Tex.

[73] Assignee: ABB Vetco Gray Inc., Houston, Tex.

[21] Appl. No.: 951,617

[22] Filed: Sep. 28, 1992

Related U.S. Application Data

[63] Continuation-in-part of Ser. No. 805,416, Dec. 10, 1991, abandoned.

[51] Int. Cl.[5] ..... E21B 23/00

[52] U.S. Cl. ..... 166/382; 166/115; 166/383; 73/40.5 R; 277/72 R; 277/119; 285/917

[58] Field of Search ..... 166/115, 208, 217, 381-383, 166/368; 73/40.5 R, 49.1; 285/382.7, 419, 917; 277/72 R, 119, 120, 191, 201

[56] References Cited

U.S. PATENT DOCUMENTS

| | | | |
|---|---|---|---|
| 3,141,685 | 7/1964 | Watts | 285/93 |
| 3,872,713 | 3/1975 | Ilfrey et al. | 73/40.5 R |
| 4,116,044 | 9/1978 | Garrett | 73/40.5 R |
| 4,152,924 | 5/1979 | Mayo | 73/40.5 R |
| 4,373,380 | 2/1983 | Mayo | 73/40.5 R |
| 4,410,186 | 10/1983 | Pierce | 277/2 |
| 4,665,979 | 5/1987 | Boehm | 166/208 |
| 4,771,828 | 9/1988 | Cassity | 166/115 |
| 4,932,472 | 6/1990 | Boehm | 166/208 |

*Primary Examiner*—Ramon S. Britts
*Assistant Examiner*—Roger J. Schoeppel
*Attorney, Agent, or Firm*—James E. Bradley

[57] ABSTRACT

A casing hanger seal has facilities to enable periodic testing from the exterior of the wellhead housing. The casing hanger seal has inner and outer walls separated by a cavity. An energizing member moves downward to force the inner and outer walls into engagement with the casing hanger and bore of the wellhead housing. Test passages extend through the inner and outer walls, energizing member, and wellhead housing. The test passages divide the seal member into primary and secondary seal areas. Applications of test fluid, from the exterior, to the test passages determines whether a leak is present.

22 Claims, 3 Drawing Sheets

CASING HANGER SEAL WITH TEST PORT

CROSS REFERENCE TO RELATED APPLICATION

This application is a continuation in part of application Ser. No. 07/805,416, filed Dec. 10, 1991 abandoned now.

BACKGROUND OF THE INVENTION

1. Field of the Invention

This invention relates in general to wellhead assemblies, and in particular to a wellhead assembly having a casing hanger located in a wellhead, a seal member which seals a space between the casing hanger in the wellhead, and test passages extending through the seal member and wellhead for testing the seal.

2. Description of the Prior Art

One type of wellhead assembly employs a casing hanger which secures to the upper end of a string of casing that is cemented in the well. A seal or packoff seals the annulus between the casing hanger and the Wellhead housing.

During installation, the seal member can be tested by using a test tool which seals in the bore of the suspended casing. This allows pressure below the blowout preventer to test the seal from above. After the well has been completed, it is desirable to periodically check to determine if the casing seal has started to leak. There is no access to the bore of the wellhead housing above the casing hanger after completion.

To handle this, some installations have an external test port extending through the wellhead housing. A special test seal will be located below the primary seal. The test port communicates with the space between the test seal and the primary seal. Pressure is applied. If the pressure holds, then that indicates that neither seal is leaking.

One drawback to the prior art procedure is that the test seal may leak, but not the primary seal. The operator would not know which seal leaks. The test seals are normally not as effective or long lasting as the primary seal, and thus are more likely to leak.

This disadvantage is particularly a problem in the case of metal-to-metal seals. Metal-to-metal seals do not deteriorate as much with age as elastomeric seals. One type of metal seal available has inner and outer cylindrical walls separated by an annular cavity. During the installation, an energizing member moves down into the cavity to force the walls apart into tight sealing engagement with the wellhead housing bore and the exterior of the casing hanger. No means exist for testing these types of metal seals, other than providing some type of elastomeric seal below the metal seal.

SUMMARY OF THE INVENTION

The casing hanger seal member of this invention is provided with a seal member test passage that extends through the seal. The test passage is located so that it will divide the seal into two portions, a primary portion located below the seal test passage and a secondary portion located above the seal member test passage. The seal energizing member also has a test passage that communicates with the seal member test passage when the energizing member is moved to its lower position.

The wellhead housing has a test passage. Once installed, the seal member test passage communicates with the wellhead housing test passage. Applying pressure to the wellhead test passage will apply pressure to the primary and secondary seal areas to determine if leakage exists.

DETAILED DESCRIPTION OF THE INVENTION

Figure 1:
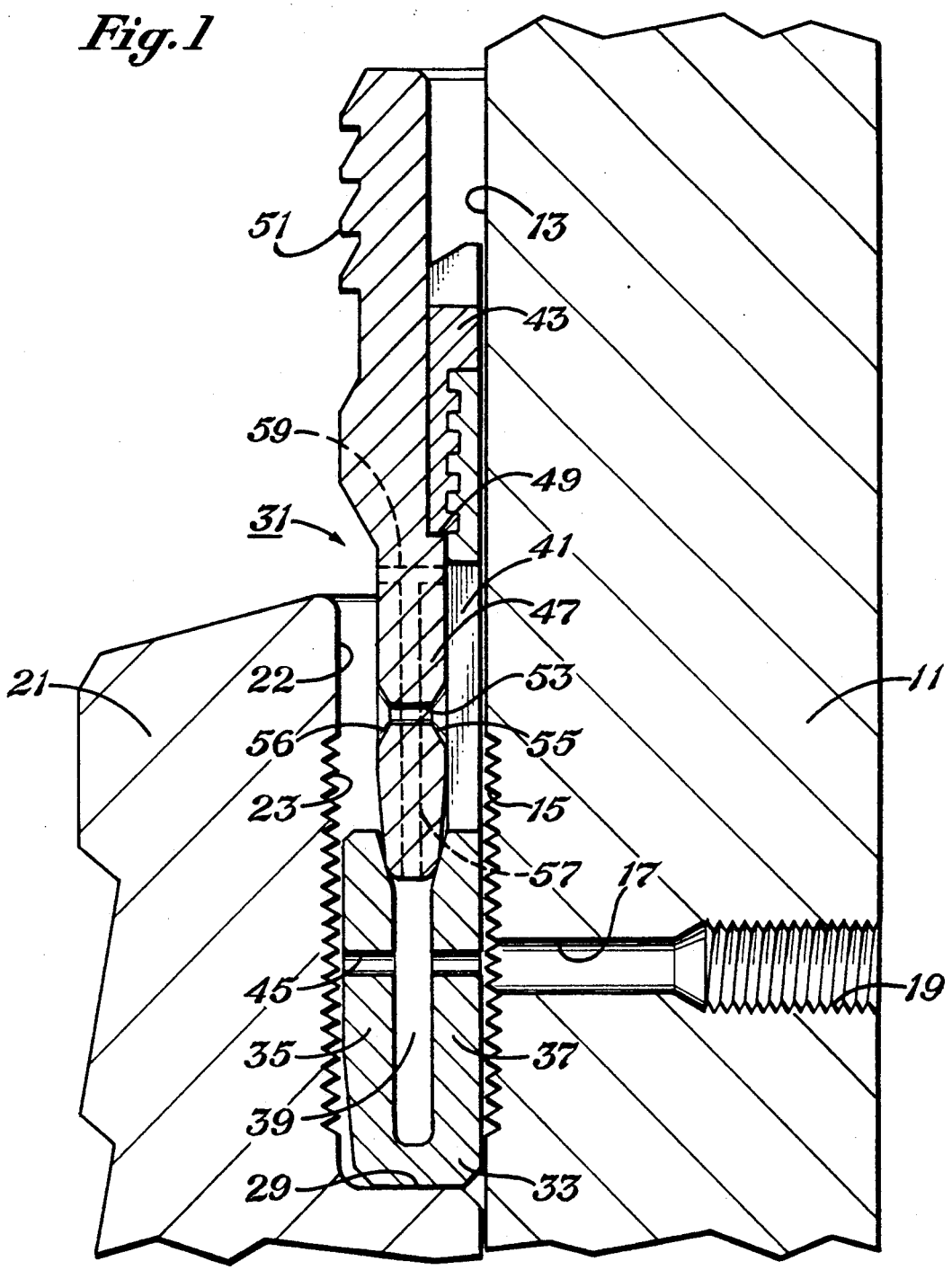
FIG. 1 is a quarter sectional view illustrating a seal assembly and portions of a casing hanger wellhead housing constructed in accordance with this invention, and showing the seal member prior to being energized.

Referring to the drawings, particularly FIG. 1, the well assembly has a wellhead housing 11. Wellhead housing 11 is a cylindrical, tubular member having an axial bore 13. In the embodiment shown, bore 13 has a plurality of wickers 15. Wickers 15 are small, circumferential, parallel grooves. Each groove is triangular in configuration and has a pitch of about one-eighth inch.

A wellhead test passage 17 extends from the exterior of wellhead housing 11 to the bore 13. Wellhead test passage 17 intersects the wickers 15 approximately at a midpoint between the lower edge and upper edge of wickers 15. A plurality of threads 19 at the outer end of wellhead test passage 17 enable a user to connect a source of hydraulic pressure for test purposes. A second passage (not shown) will extend through wellhead housing 11 perpendicular to test passage 17. The second passage is normally not used for testing, but is used for bleed off in case sealant is injected through wellhead test passage 17 to stop leakage.

A casing hanger 21 lands in wellhead housing !1 and will support a string of casing (not shown) which is cemented in the well. Casing hanger 21 has an upper exterior wall 22 that is spaced inward from bore 13. A plurality of wickers 23 are formed on exterior wall 22 and are positioned to be adjacent wellhead housing wickers 15. Wickers 23 are identical to wickers 15 in size and in number.

Casing hanger 21 has an upward facing landing shoulder 29 located at the base of exterior wall 22. A seal assembly 31 is lowered into the annular space between exterior wall 22 and bore 13, landing on landing shoulder 29. Seal assembly 31 includes an annular metal-to-metal seal member 33 that is generally U-shaped in cross section. Seal member 33 has an inner cylindrical wall 35 and outer cylindrical wall 37 joined by a base. The inner wall 35 is spaced from the outer wall 37 radially, defining an annular cavity 39. Seal member 33 has an upper section 41 that joins the outer wall 37 and extends upward above casing hanger 21. A retainer 43 is secured by threads to the upper end of upper section 41.

Seal member 33 has two test passages 45, each located 180 degrees apart from each other (only one shown) around the circumference of seal member 33. Each test passage 45 extends radially through the inner wall 35 and the outer wall 37. When seal member 33 is located on landing shoulder 29, seal member test passage 45 will communicate with wellhead test passage 17. Seal member test passages 45 will be located the same distance above shoulder 29 as the wellhead housing test passage 17. Neither seal member test passage 45 has to be coaxially aligned with the wellhead housing test passage 17 because communication through at least one of the wickers 15 exists.

Figure 2:
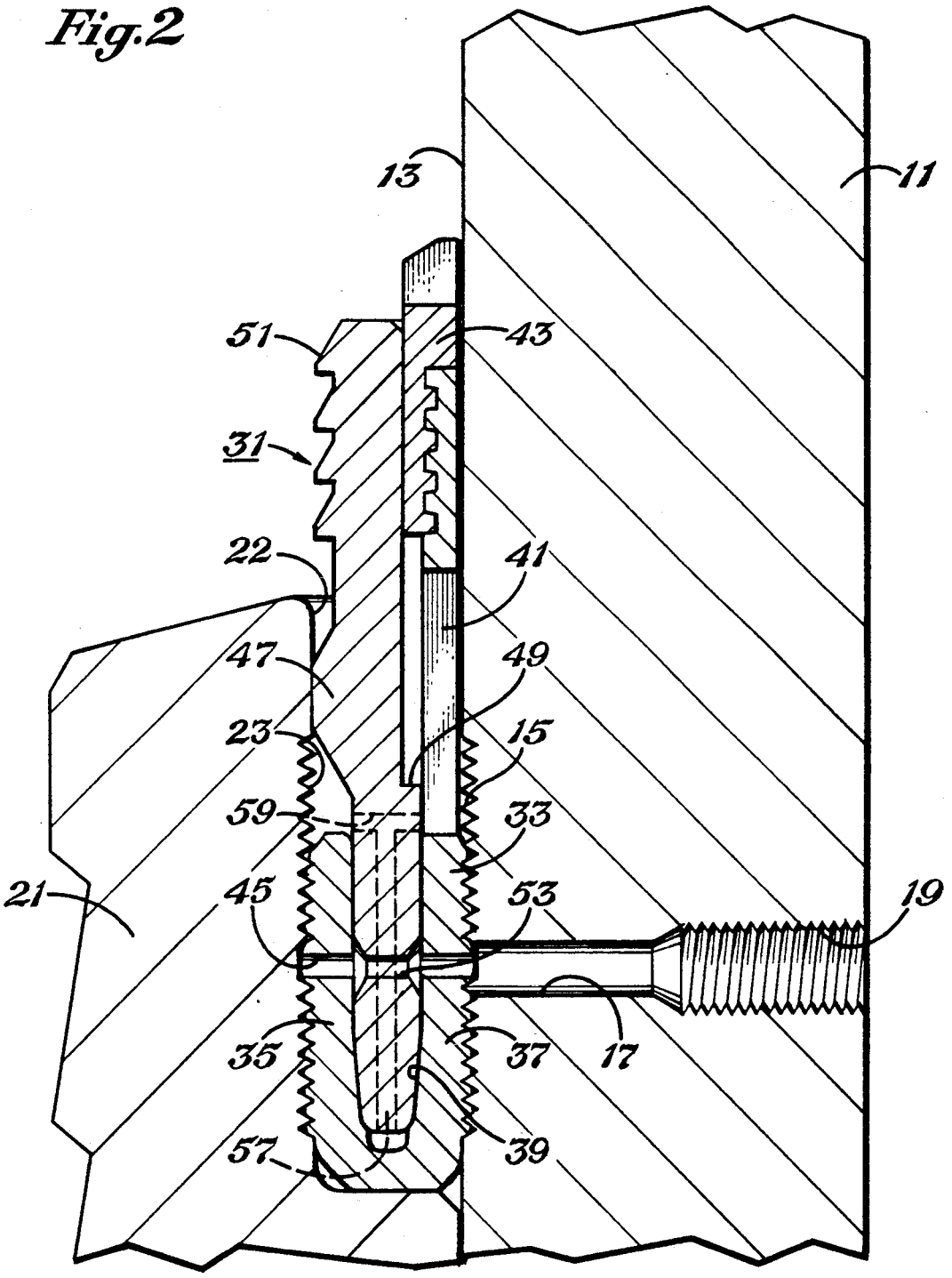
FIG. 2 is a sectional view of the seal member, casing hanger, and wellhead housing of FIG. 1, and showing the seal member in an energized position.

An energizing member 47 moves between an upper position shown in FIG. 1 and a lower position shown in FIG. 2 for deforming the inner and outer walls 35, 37 apart from each other into sealing engagement with the wickers 15, 23. Energizing member 47 is a cylindrical member having a greater radial thickness than the radial width of cavity 39. Energizing member 47 has an upward facing shoulder 49 that will contact the retainer 43 if energizing member 47 is pulled upward for removing the seal assembly 31. A plurality of grooves 51 on the inner diameter of energizing member 47 serve for engagement with a running tool (not shown).

Energizing member 47 has a pair of test passages 53, (only one shown) each spaced 180 degrees apart around the circumference of energizing member 47 and coaxial with each other. Each test passage 53 extends radially through the energizing member 47. Each test passage 53 is positioned to communicate with test passages 17 and 45 when energizing member 47 is in the lower position shown in FIG. 2. In that position, test passage 53 will be located the same distance above the lower end of seal member 33 as the seal member test passage 45. A recess 55 extends around the outer diameter of energizing member 47 at the entrance of test passage 53. Similarly, an annular recess 56 locates on the inner diameter at the exit of test passage 53. It is not necessary for test passage 53 to coaxially align with test passage 45 because communication will exist through the recesses 55, 56.

Energizing member 47 also has two displacement passages 57, spaced 180 degrees apart from each other (only one shown) around the circumference of energizing member 47. Each displacement passage 57 is a vertical hole drilled 90 degrees from the test passages 53 around the circumference of energizing member 47 so as to not intersect the test passages 53. The 90 degree spacing prevents the displacement passages 57 from communication with test passages 45, 17 and 53. Each displacement passage 57 also includes a horizontal portion 59 located so as to be above the upper end of inner wall 35 when the energizing member 47 is in the lower position. Displacement passages 57, 59 enable liquid trapped in cavity 39 to be displaced out during installation.

Figure 3:
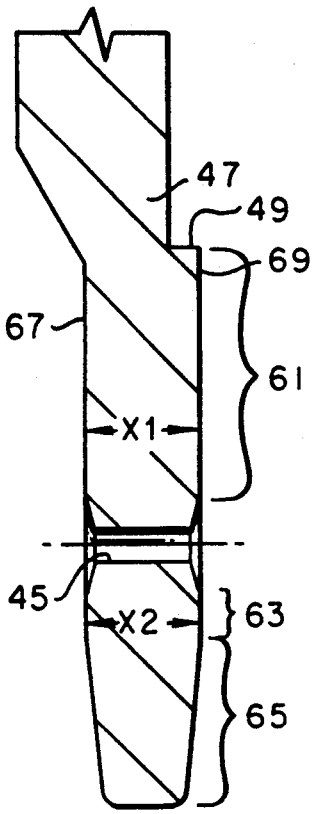
FIG. 3 is an enlarged quarter sectional view illustration a portion of the energizing ring of the seal assembly Of FIG. 1.

Referring to FIG. 3, energizing member 47 has an upper portion 61 which extends from shoulder 49 down to the test passage 45. Energizing member 47 has an intermediate portion 63 that extends from test passage 45 downward a short distance. A nose section 65 extends from intermediate portion 63 to the lower end of energizing member 47.

Energizing member 47 is an annular ring, having an inner wall 67 and an outer wall 69. Walls 67, 69 are concentric cylindrical surfaces parallel to each other in the upper portion 61 and in the intermediate portion 63. Walls 67, 69 are conical surfaces that taper and converge toward each other in the nose section 65.

Testing has indicated that better sealing occurs if the wall thickness X1 in the upper portion 61 is greater than the wall thickness X2 in the intermediate portion 63. The difference in thickness is slight. The thickness X2 in the preferred embodiment is only 0.0010 inch less than the thickness X1. The thickness X2 immediately below the test passage 45 will be slightly less than the thickness X1 immediately above test passage 45. The wall thicknesses X1, X2 are measured perpendicular to the longitudinal axis of energizing member 47.

Figure 4:
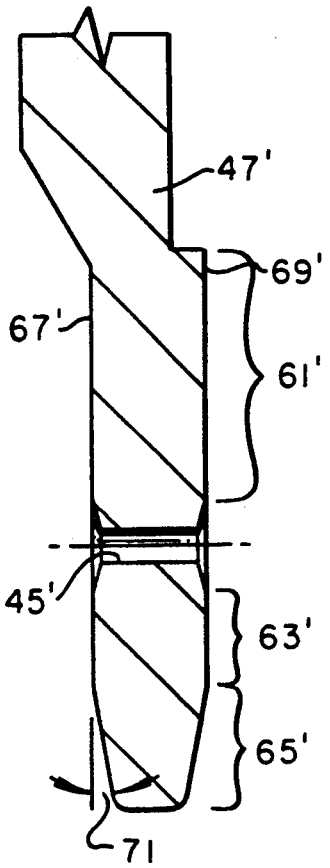
FIG. 4 is an enlarged cross sectional view of an alternate embodiment of an energizing ring for a seal assembly.

In the alternate embodiment of FIG. 4, the energizing member 47 has an upper portion 61' that is identical to the upper portion 61 of FIG. 3. However, the intermediate portion 63' differs from intermediate portion 63. The sidewalls 67' and 69' of intermediate portion 63' are conical, not cylindrical and converge similar to, but not at the same angle as the sidewalls of nose section 65'. The angle 71 at which each sidewall 67', 69' of intermediate portion 63' converges is quite small, and less than the converging angle for nose section 65'. The wall thickness of intermediate portion 63' immediately below test port 45' is the same as the wall thickness of upper portion 61 immediately above test port 45'. However, the wall thickness just below test port 45' immediately decreases due to the angle 71.

In operation, the operator will land the casing hanger 21 in wellhead housing 11 and cement the casing (not shown). The operator will then place the seal assembly 31 on landing shoulder 29. The operator will actuate a running tool (not shown) to push the energizing member 47 down with great force. Trapped fluid in cavity 39 flows out displacement passages 57, 59. The downward force pushes the inner and outer walls 35, 37 apart from each other, causing the inner wall 35 to embed in wickers 23. The outer wall 37 embeds in wickers 15.

The test passages 45, 53 and 17 will vertically align with each other so as to be in fluid communication. It is unlikely and unnecessary that the test passages 45, 53 and 17 radially align so that each axis of each test passage 45, 53, and 17 is coaxially with the others, however. The test passages 45, 53 and 17 divide the seal into two separate sealing areas. A primary sealing area will be at the lower portion below the test passages 45, 53 and 17. Any annulus pressure in the well will be sealed by the primary sealing areas of the inner and outer walls 35, 37 below the test passages 45, 53 and 17. A secondary seal will be at the upper portion above the test passages 45, 53 and 17. Similarly, the inner and outer walls 67, 69 of the energizing member 47 form seals with the inner and outer walls of cavity 39. Because of the test ports 45, 53 and 17, as well as the recesses 55 and 56, these inner areas will also form two primary and secondary seals.

Periodically, an operator will perform a test to determine if leakage exists. Normally, a check valve fitting (not shown) will be connected to threads 19. The operator connects a hydraulic pump for pumping a liquid through the test passage 17. The liquid flows around one or more of the wickers 15 located at the exit of wellhead test passage 17 and into the entrance of seal member test passage 45. The liquid flows through the seal member test passage 45 in outer wall 37, around recess 55, and into the entrance of energizing member test passage 53. The liquid flows out energizing member test passage 53, around recess 56, and into the seal member test passage 45 of the inner wall 35.

The test fluid is prevented from flowing downward by the primary sealing areas of the inner and outer walls 35, 37 below the test passages 45, 53 and 17. Also, the inner and outer surface of the energizing member 47 sealing against the walls of cavity 39 prevent any fluid from flowing downward. Similarly, the engagement of the inner and outer walls 35, 37 with wickers 23, 15 above the test passages 45, 53 and 17 prevent any fluid from flowing upward. The engagement of the inner and outer walls of energizing member 47 with the inner and outer walls of cavity 39 prevent any fluid from flowing upward from cavity 39. The test fluid will not be in communication with the displacement fluid passages 57, 59. If the test indicates a drop in pressure, then leakage through one or more of these areas exists and repair is necessary.

The invention has significant advantages. The seal member enables the seal to be periodically tested from the exterior. Dividing the metal seal member into primary and secondary seal areas with test passages provides an opportunity for testing without the need for a special elastomeric test seal, which is subject to deterioration.

While the invention has been shown in only one of its forms, it should be apparent to those skilled in the art that it is not so limited, but is susceptible to various changes without departing from the scope of the invention.

We claim:

1. In a wellhead assembly of the type having a wellhead housing, a casing hanger landed in a bore of the wellhead housing for supporting a string of casing, an annular space located between the casing hanger and the wellhead housing bore, a metal seal member located in the annular space having cylindrical inner and outer walls spaced radially apart from each other, defining a central annular cavity, an annular energizing member carried by the seal member and movable between an upper position spaced above the cavity and a lower position in the cavity forcing the inner and outer walls apart to seal the annular space, the improvement comprising in combination:

a wellhead housing test passage extending laterally from the exterior of the wellhead housing to the bore of the wellhead housing in the annular space;

a seal member test passage extending laterally through each of the inner and outer walls of the seal member in communication with the wellhead housing test passage;

an energizing member test passage extending laterally through the energizing member in communication with the seal member test passage when the energizing member is in the lower position, enabling an operator to apply pressure to the wellhead housing, seal member, and energizing member test passages to determine if leakage past the seal exists.

2. The wellhead assembly according to claim 1 wherein the energizing member has an upper portion and a lower portion terminating in a tapered nose, the upper portion locating above the seal member test passage and the lower portion and nose locating below the seal member test passage when the energizing member is in the lower position; and wherein the upper portion of the energizing member has a cross-sectional thickness and the lower portion of the energizing member has a cross-sectional thickness that is less than the cross-sectional thickness of the upper portion.

3. The wellhead assembly according to claim 1 wherein the energizing member has an upper portion and a lower portion, terminating in a tapered nose, the upper and lower portions each having concentric cylindrical inner and outer walls, the upper portion locating above the seal member test passage and the lower portion and nose locating below the seal member test passage when the energizing member is in the lower position; and wherein the upper portion of the energizing member has a constant cross-sectional thickness and the lower portion of the energizing member has a constant cross-sectional thickness that is slightly less than the cross-sectional thickness of the upper portion.

4. The wellhead assembly according to claim 1 wherein the energizing member has an upper portion and a lower portion, terminating in a tapered nose, the upper portion having parallel inner and outer walls, the upper portion locating above the seal member test passage and the lower portion and nose locating below the seal member test passage when the energizing member is in the lower position; and wherein the upper portion of the energizing member has a constant cross-sectional thickness and the lower portion of the energizing member has a tapered cross-sectional thickness that has an upper margin that is of no greater thickness than the upper portion and which decreases in thickness in a downward direction to a lower margin at the junction with the nose.

5. In a wellhead assembly of the type having a wellhead housing, a casing hanger landed in a bore of the wellhead housing for supporting a string of casing, an annular space located between the casing hanger and the wellhead housing bore, a metal seal member located in the annular space, an annular energizing member carried by the seal member and movable to a lower position to deform the seal member to seal the annular space, the improvement comprising in combination:

a wellhead housing test passage extending laterally from the exterior of the wellhead housing to the bore of the wellhead housing in the annular space;

a seal member test passage extending laterally through the seal member in communication with the wellhead housing test passage; and an energizing member test passage extending laterally through the energizing member in communication with the seal member test passage when the energizing member is in the lower position, enabling an operator to apply pressure to the wellhead housing, seal member, and energizing member test passages to determine if leakage past the seal exists.

6. The wellhead assembly according to claim 5 wherein a lower portion of the seal member below the seal member test passage and an upper portion of the seal member above the seal member test passage sealingly engage the casing hanger and bore of the wellhead housing, forming primary and secondary seals, respectively.

7. In a wellhead assembly of the type having a wellhead housing, a casing hanger landed in a bore of the wellhead housing for supporting a string of casing, an annular space located between the casing hanger and the wellhead housing bore, a metal seal member located in the annular space, an annular energizing member carried by the seal member and movable to a lower position to deform the seal member to seal the annular space, the improvement comprising in combination:

a wellhead housing test passage extending from the exterior of the wellhead housing to the bore of the wellhead housing in the annular space;

a seal member test passage extending through the seal member in communication with the wellhead housing test passage; and an energizing member test passage extending through the energizing member in communication with the seal member test passage when the energizing member is in the lower position, enabling an operator to apply pressure to the wellhead housing, seal member, and energizing member test passages to determine if leakage past the seal exists; and wherein the energizing member has an upper portion and a lower portion terminating in a tapered nose, the upper portion locating above the energizing member test passage and the lower portion and nose locating below the energizing member test passage when the energizing member is in the lower position; and wherein the upper portion of the energizing member has a cross-sectional thickness and the lower portion of the energizing member has a cross-sectional thickness that is less than the cross-sectional thickness of the upper portion.

8. In a wellhead assembly of the type having a wellhead housing, a casing hanger landed in a bore of the wellhead housing for supporting a string of casing, an annular space located between the casing hanger and the wellhead housing bore, a metal seal member located in the annular space, an annular energizing member carried by the seal member and movable to a lower position to deform the seal member to seal the annular space, the improvement comprising in combination:

a wellhead housing test passage extending from the exterior of the wellhead housing to the bore of the wellhead housing in the annular space;

a seal member test passage extending through the seal member in communication with the wellhead housing test passage; and an energizing member test passage extending through the energizing member in communication with the seal member test passage when the energizing member is in the lower position, enabling an operator to apply pressure to the wellhead housing, seal member, and energizing member test passages to determine if leakage past the seal exists; and wherein the energizing member has an upper portion and a lower portion, terminating in a tapered nose, the upper and lower portions each having concentric, cylindrical inner and outer walls, the upper portion locating above the energizing member test passage and the lower portion and nose locating below the energizing member test passage when the energizing member is in the lower position; and wherein the upper portion of the energizing member has a constant cross-sectional thickness and the lower portion of the energizing member has a constant cross-sectional thickness that is slightly less than the cross-sectional thickness of the upper portion.

9. In a wellhead assembly of the type having a wellhead housing, a casing hanger landed in a bore of the wellhead housing for supporting a string of casing, an annular space located between the casing hanger and the wellhead housing bore, a metal seal member located in the annular space, an annular energizing member carried by the seal member and movable to a lower position to deform the seal member to seal the annular space, the improvement comprising in combination:

a wellhead housing test passage extending from the exterior of the wellhead housing to the bore of the wellhead housing in the annular space;

a seal member test passage extending through the seal member in communication with the wellhead housing test passage; and an energizing member test passage extending through the energizing member in communication with the seal member test passage when the energizing member is in the lower position, enabling an operator to apply pressure to the wellhead housing, seal member, and energizing member test passages to determine if leakage past the seal exists; and wherein the energizing member has an upper portion and a lower portion, terminating in a tapered nose, the upper portion having parallel cylindrical inner and outer walls, the upper portion locating above the seal member test passage and the lower portion and nose locating below the seal member test passage when the energizing member is in the lower position; and wherein the upper portion of the energizing member has a constant cross-sectional thickness and the lower portion of the energizing member has a tapered cross-sectional thickness that has an upper margin that is of no greater thickness than the upper portion and which decreases in thickness in a downward direction to a lower margin at the junction with the nose.

10. In a wellhead assembly of the type having a wellhead housing, a casing hanger landed in a bore of the wellhead housing for supporting a string of casing, an annular space located between the casing hanger and the wellhead housing bore, a seal member located in the annular space having cylindrical inner and outer walls spaced radially apart from each other, defining a central annular cavity, an annular energizing member carried by the seal member and movable between an upper position spaced above the cavity and to a lower position in the cavity forcing the inner and outer walls apart to seal the annular space, the improvement comprising in combination:

a wellhead housing test passage extending from the exterior of the wellhead housing to the bore of the wellhead housing in the annular space;

a seal member test passage extending through each of the inner and outer walls of the seal member in communication with the wellhead housing test passage;

an energizing member test passage extending through the energizing member in communication with the seal member test passage when the energizing member is in the lower position, enabling an operator to apply pressure to the wellhead housing, seal member, and energizing member test passages to determine if leakage past the seal exists;

the energizing member having an upper portion and a lower portion terminating in a tapered nose, the upper portion locating above the energizing member test passage and the lower portion and nose locating below the energizing member test passage when the energizing member is in the lower position; and the upper portion of the energizing member having a cross-sectional thickness and the lower portion of the energizing member has a cross-sectional thickness that is less than the cross-sectional thickness of the upper portion.

11. The wellhead assembly according to claim 10 wherein the upper portion and the lower portion each has parallel inner and outer walls, providing constant cross-sectional thicknesses in the upper and the lower portion.

12. The wellhead assembly according to claim 10 wherein the upper portion has a constant cross-sectional thickness and the lower portion of the energizing member has a tapered cross-sectional thickness that has an upper margin that is of no greater thickness than the upper portion and which decreases in thickness in a downward direction to a lower margin at the junction with the nose.

13. The wellhead assembly according to claim 10 wherein a lower portion of the seal member below the seal member test passage and an upper portion of the seal member above the seal member test passage sealingly engage the casing hanger and bore of the wellhead housing, forming primary and secondary seals, respectively.

14. The wellhead assembly according to claim 10 further comprising:

displacement passage means extending from a lower end of the energizing member upward for allowing trapped fluid contained in the cavity to flow out of the cavity as the energizing member moves to the lower position.

15. In a wellhead assembly of the type having a wellhead housing, a casing hanger landed in a bore of the wellhead housing for supporting a string of casing, an annular space located between the casing hanger and the wellhead housing bore, a seal member located in the annular space having cylindrical inner and outer walls spaced radially apart from each other, defining a central annulus cavity, an annular energizing member carried by the seal member and movable between an upper position spaced above the cavity and a lower position in the cavity, forcing the inner and outer walls apart to seal the annular space, the improvement comprising in combination:

a wellhead housing test passage extending laterally from the exterior of the wellhead housing to the bore of the wellhead housing in the annular space;

a seal member test passage extending laterally through each of the inner and outer walls in communication with the wellhead housing test passage, the seal member test passage dividing the seal member into a lower portion which forms a primary seal with the wellhead housing and the casing hanger and an upper portion which forms a secondary seal with the wellhead housing and casing hanger;

an energizing member test passage laterally extending through the energizing member in communication with the seal member test passage when the energizing member is in the lower position, enabling an operator to apply pressure to the wellhead housing, seal member, and energizing member test passages to determine if leakage past the primary and secondary seals exist; and a displacement passage extending through the energizing member to the exterior of the energizing member from a lower end of the energizing member upward for allowing trapped fluid contained in the cavity to flow out of the cavity as the energizing member moves to the lower position.

16. In a wellhead assembly of the type having a wellhead housing, a casing hanger landed in a bore of the wellhead housing for supporting a string of casing, an annular space located between the casing hanger and the wellhead housing bore, a metal seal member located in the annular space having cylindrical inner and outer walls spaced radially apart from each other, defining a central annulus cavity, an annular energizing member carried by the seal member and movable between an upper position spaced above the cavity and a lower position in the cavity, forcing the inner and outer walls apart to seal the annular space, the improvement comprising in combination:

a wellhead housing test passage extending from the exterior of the wellhead housing to the bore of the wellhead housing in the annular space;

a seal member test passage extending through each of the inner and outer walls in communication with the wellhead housing test passage, the seal member test passage dividing the seal member into a lower portion which forms a primary seal with the wellhead housing and the casing hanger and an upper portion which forms a secondary seal with the wellhead housing and casing hanger;

an energizing member test passage extending through the energizing member in communication with the seal member test passage when the energizing member is in the lower position, enabling an operator to apply pressure to the wellhead housing, seal member, and energizing member test passages to determine if leakage past the primary and secondary seals exist; and a displacement passage extending through the energizing member to the exterior of the energizing member from a lower end of the energizing member upward for allowing trapped fluid contained in the cavity to flow out of the cavity as the energizing member moves to the lower position; and wherein the displacement passage is isolated from the energizing member test passage.

17. The wellhead assembly according to claim 15 wherein an annular recess extends around each side of the energizing member at an entrance and exit of the energizing member test passage.

18. The wellhead assembly according to claim 15 wherein the energizing member has an upper portion and a lower portion terminating in a tapered nose, the upper portion locating above the energizing member test passage and the lower portion and nose locating below the energizing member test passage when the energizing member is in the lower position; and wherein the upper portion of the energizing member has a cross-sectional thickness and the lower portion of the energizing member has a cross-sectional thickness that is less than the cross-sectional thickness of the upper portion.

19. In a wellhead assembly of the type having a wellhead housing, a casing hanger landed in a bore of the wellhead housing for supporting a string of casing, an annular space located between the casing hanger and the wellhead housing bore, a metal seal member located in the annular space having cylindrical inner and outer walls spaced radially apart from each other, defining a central annulus cavity, an annular energizing member carried by the seal member and movable between an upper position spaced above the cavity and a lower position in the cavity, forcing the inner and outer walls apart to seal the annular space, the improvement comprising in combination:

a wellhead housing test passage extending from the exterior of the wellhead housing to the bore of the wellhead housing in the annular space;

a seal member test passage extending through each of the inner and outer walls in communication with the wellhead housing test passage, the seal member test passage dividing the seal member into a lower portion which forms a primary seal with the wellhead housing and the casing hanger and an upper portion which forms a secondary seal with the wellhead housing and casing hanger;

an energizing member test passage extending through the energizing member in communication with the seal member test passage when the energizing member is in the lower position, enabling an operator to apply pressure to the wellhead housing, seal member, and energizing member test passages to determine if leakage past the primary and secondary seals exist; and a displacement passage extending through the energizing member to the exterior of the energizing member from a lower end of the energizing member upward for allowing trapped fluid contained in the cavity to flow out of the cavity as the energizing member moves to the lower position; and wherein the energizing member has an upper portion and a lower portion, terminating in a tapered nose, the upper and lower portions each having parallel cylindrical inner and outer walls, the upper portion locating above the energizing member test passage and the lower portion and nose locating below the energizing member test passage when the energizing member is in the lower position; and wherein the upper portion of the energizing member has a constant cross-sectional thickness and the lower portion of the energizing member has a constant cross-sectional thickness that is slightly less than the cross-sectional thickness of the upper portion.

20. In a wellhead assembly of the type having a wellhead housing, a casing hanger landed in a bore of the wellhead housing for supporting a string of casing, an annular space located between the casing hanger and the wellhead housing bore, a metal seal member located in the annular space having cylindrical inner and outer walls spaced radially apart from each other, defining a central annulus cavity, an annular energizing member carried by the seal member and movable between an upper position spaced above the cavity and a lower position in the cavity, forcing the inner and outer walls apart to seal the annular space, the improvement comprising in combination:

a wellhead housing test passage extending from the exterior of the wellhead housing to the bore of the wellhead housing in the annular space;

a seal member test passage extending through each of the inner and outer walls in communication with the wellhead housing test passage, the seal member test passage dividing the seal member into a lower portion which forms a primary seal with the wellhead housing and the casing hanger and an upper portion which forms a secondary seal with the wellhead housing and casing hanger;

an energizing member test passage extending through the energizing member in communication with the seal member test passage when the energizing member is in the lower position, enabling an operator to apply pressure to the wellhead housing, seal member, and energizing member test passages to determine if leakage past the primary and secondary seals exist; and a displacement passage extending through the energizing member to the exterior of the energizing member from a lower end of the energizing member upward for allowing trapped fluid contained in the cavity to flow out of the cavity as the energizing member moves to the lower position; and wherein the energizing member has an upper portion and a lower portion, terminating in a tapered nose, the upper and lower portion having parallel cylindrical inner and outer walls, the upper portion locating above the seal member test passage and the lower portion and nose locating below the seal member test passage when the energizing member is in the lower position; and wherein the upper portion of the energizing member has a constant cross-sectional thickness and the lower portion of the energizing member has a tapered cross-sectional thickness that has an upper margin that is of no greater thickness than the upper portion and which decreases in thickness in a downward direction to a lower margin at the junction with the nose.

21. In a method of installing a casing hanger within a bore of a wellhead housing, including installing between the casing hanger and wellhead housing a seal member with cylindrical inner and outer walls spaced radially from each other, moving an annular energizing member downward to a lower position between the inner and outer walls and forcing apart the inner and outer walls to seal between the wellhead housing and the casing hanger, the improvement comprising:

providing a wellhead housing test passage extending laterally from the exterior of the wellhead to the bore of the wellhead housing;

providing a seal member test passage extending laterally through each of the inner and outer walls in communication with the wellhead housing test passage;

providing an energizing member test passage extending laterally through the energizing member in communication with the seal member test passage when the energizing member is in the lower position; and applying pressure to the wellhead housing, seal member and energizing member test passages and monitoring the bore of the wellhead housing to determine if leakage exists.

22. The method according to claim 21 wherein the step of providing a seal member test passage locates the seal member test passage so that the downward movement of the energizing member provides a primary seal below the seal member test passage and a secondary seal above the seal member test passage.

* * * * *